United States Patent [19]

Bhatt et al.

[11] 4,305,509

[45] Dec. 15, 1981

[54] INSTRUMENT RACK

[75] Inventors: Niranjan R. Bhatt, Windson, Conn.; Dana C. Chase, Longmeadow, Mass.

[73] Assignee: Combustion Engineering, Inc., Windsor, Conn.

[21] Appl. No.: 126,277

[22] Filed: Mar. 3, 1980

[51] Int. Cl.[3] ..... A47F 5/10; F28D 15/00

[52] U.S. Cl. ..... 211/26; 165/80 C; 361/385

[58] Field of Search ..... 211/26, 13, 191, 189; 248/176; 361/385; 165/80 C, 80 E

[56] References Cited

U.S. PATENT DOCUMENTS

| | | | |
|---|---|---|---|
| 2,518,624 | 8/1950 | Kraft | 211/13 |
| 2,692,961 | 10/1954 | Fondiller | 165/80 C X |
| 2,733,113 | 1/1956 | Humbargar | 211/13 X |
| 2,912,624 | 11/1959 | Wagner | 165/80 C X |
| 3,164,256 | 1/1965 | Bennett | 211/189 X |
| 3,776,305 | 12/1973 | Simmons | 361/385 X |
| 3,905,483 | 9/1975 | Patrick | 211/26 X |

*Primary Examiner*—James A. Leppink
*Attorney, Agent, or Firm*—Arthur L. Wade

[57] ABSTRACT

A support rack is shown as constructed of stainless steel angle members permanently welded together so as to comply with seismic requirements for nuclear power plant components. The four basic sides of the rack form a rectangle with the longer sides vertically extended. Permanent stainless steel plates extend between the vertical sides of the rack to add to the overall stability of the rack and form mounting bases. To some of the mounting bases is removably connected a second plate which bears signal transducers and transmitters. The rack is adapted for both floor and wall mounting at its permanent station.

5 Claims, 5 Drawing Figures

INSTRUMENT RACK

TECHNICAL FIELD

The present invention is related to frameworks for the support of signal transducers and transmitters in locations at which huge physical shocks are anticipated which threaten to dislodge the transducers and transmitters with possible disruption of their utility and function. More particularly, the invention relates to the construction and arrangement of racks which can be altered in configuration to accommodate mounting of signal transducers and transmitters as the need for the devices develops after the initial installation.

BACKGROUND ART

In the development of nuclear power station generators, there is an increase in the demand for safety measures. Presently, the specifications of regulatory authorities are stipulating safeguards requiring that all the equipment associated with the nuclear power generating station successfully resist present and anticipated physical stresses and hostile environments such as those produced by seismic disturbances and loss of coolant accidents.

Attention is now focused on the rack required to support devices such as signal transducers and transmitters. These transducers and transmitters are important links between the primary sensing and control elements and the instruments and controls centralized for supervision by personnel. The primary sensing elements for variables, such as temperature, level, flow and pressure, are dispersed widely throughout the nuclear power generating station. The flows of particular concern are those of pumps and primary fluid systems throughout the installation. Many fluid levels are to be sensed and controlled. Temperatures are to be monitored and maintained within prescribed limits. Pressures must be sensed and regulated in a myriad of locations. Of particular concern are the high pressure boundaries in piping throughout the installation. Throughout the system, there are groups of signal transducers and transmitters which relay the primary element signals to the control room and deliver responsive control signals from the control room to valves and other regulatory devices. These transducing and transmitting devices, along with the conduits, valves and piping associated with them, must be mounted with the utmost dependability, accessibility and flexibility.

The rack for signal transducers and transmitters is subject to the most rigid technological standards of governmental regulatory agencies. Fundamentally, the rack must perform its support function during normal operation, during any accident within the installation, and during any post-accident period. It has now developed that there is a need for flexibility in the rack not heretofore provided by the prior art. There is a demand for changes in the number and mounting of transducers and transmitters after the original installation of the rack. There remains a need for parts of the rack to be permanent in order to preserve the stability and dependability of the rack in its simple support function. However, experience is dictating the need for provisions with which to modify the rack to accommodate changes in the number and mounting of transducers and transmitters. Meanwhile, the sturdy rack must not require maintenance, such as painting, but must successfully resist any strain of forces from its environment.

DISCLOSURE OF INVENTION

The present invention contemplates a support rack basically comprised of elongated structural members of stainless steel joined permanently to each other and adapted to be mounted permanently on a floor or wall location. Additional members in plate form are extended between elongated members of the rack and permanently joined thereto. Impermanent plates are detachably connected to the permanent plates and are adapted to support transducers and transmitters which must be added subsequent to the original installation without degrading the capability of withstanding rigors of the environment.

Other objects, advantages and features of the invention will become apparent to one skilled in the art upon consideration of the written specifications, appended claims, and accompanying drawings.

BEST MODE FOR CARRYING OUT THE INVENTION

Figure 1:
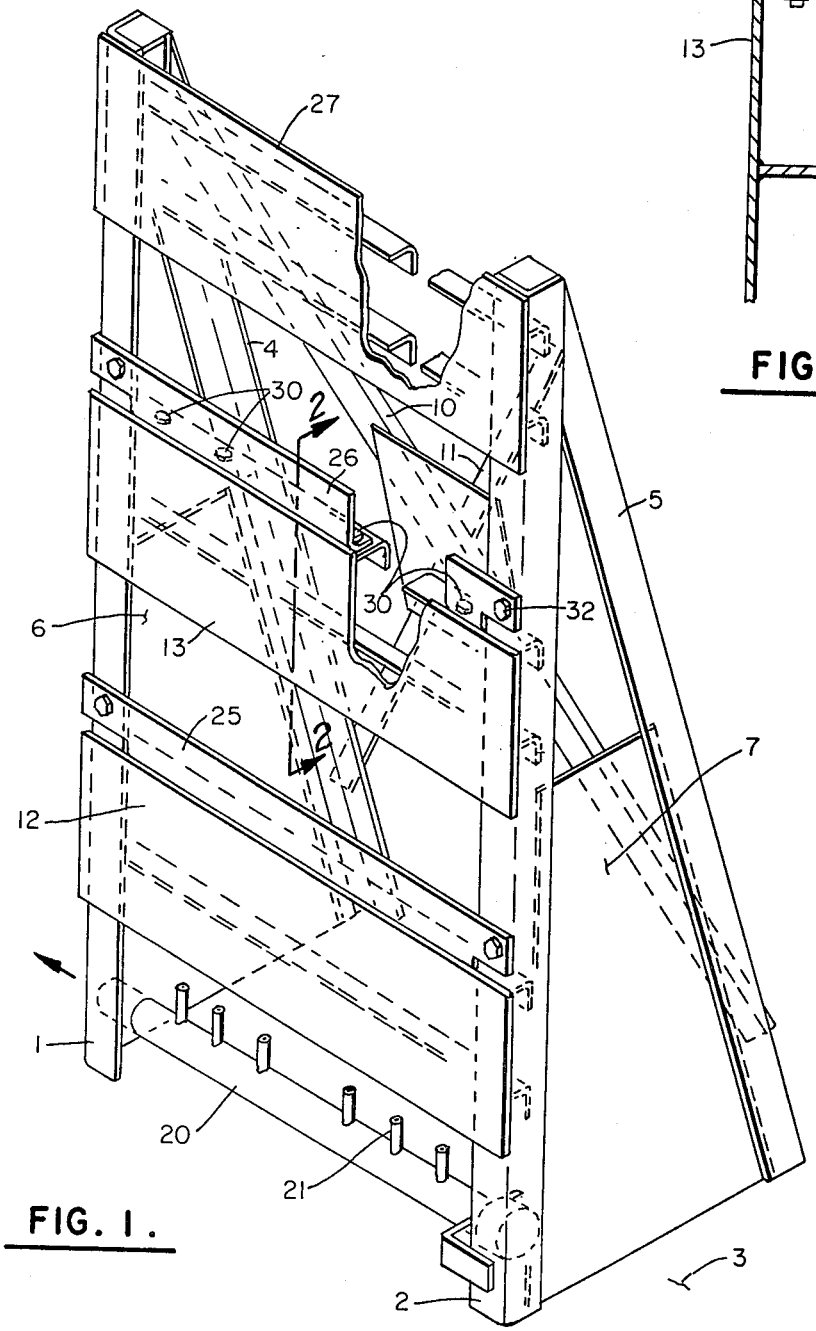
FIG. 1 is an isometric evaluation of a floor-mounted rack for transducers and transmitters embodying the present invention.

Referring to FIG. 1, the rack embodying the invention is disclosed as organized about two parallel vertical angles 1 and 2 of stainless steel. These parallel, vertically elongated structural members are disclosed in FIG. 1 as supported from a level floor surface 3. The members 1 and 2 are joined to each other by horizontal structures, but the resulting rectangular unit is provided stability on floor surface 3 by elongated members 4 and 5 which extend from permanent attachment to the upper ends of members 1 and 2 to a location on Floor 3 which is a substantial distance from the lower ends of members 1 and 2.

Support structures 4 and 5 are given further stable attachment to members 1 and 2 by reason of plates 6 and 7 which are permanently attached to substantial lengths of the structural members 1, 2, 4 and 5. More specifically, plates 6 and 7 are each in the form of truncated triangles whose lower edges extend to floor 3 and whose upper edges terminate a substantial distance up the lengths of the elongated structural members they join.

Cross braces 10 and 11 are then permanently attached between the upper ends of structural members 1 and 2 and the lower ends of structural members 4 and 5. The result is a basically complete structural support unit under the concepts of the invention.

Additonal integrity for the rack is provided by a number of plate structures extended between elongated structural members 1 and 2 and attached permanently to these members 1 and 2. In FIG. 1, plates 12, 13 and 27 are shown as these flat plate structures. The inclusion of these plates and their stiffening ribs in the rack complete the structure as ready to receive the desired number of transducers and transmitters as needed for the particular support function of the rack. All of the members of the rack described to this point are of stainless steel. Further, the structures are attached to each other as described and shown in FIG. 1 in a permanent fashion. It is assumed that these structures are permanently connected by welding to form "built-in" joints that carry through the assembly the designed strength and rigidity.

Assuming that the rack of FIG. 1 is mounted at an assigned location on floor 3, the transducers and transmitters mounted upon this rack will be connected to primary elements and the control room through necessary tubing and wiring. Manifold 20 is disclosed as mounted near the bottom of the rack to support the drain lines leaving the rack. The branch lines from the transducers and transmitters mounted on the rack are indicated at 21. The specific inclusion of transducers and transmitters as mounted on the rack is unnecessary to disclose the present invention. It can be generally understood that the lines 21 extend upward from manifold 20 to those transducers and transmitters mounted on the plates extending between structures 1 and 2 and that input lines from primary sensing and control elements come to the same transducers and transmitters from field connections.

REMOVABLE PLATES

Although not limited thereto, the lines 21 extending vertically from manifold 20 and the input fluid sensing lines are generally attached by suitable fasteners to the permanent plates 12 and 13. Again, although not limited thereto, the various transducers and transmitters supported by the rack are specifically attached to removable plates 25 and 26. It is the fundamental concept of flexibility that plates 25 and 26 be detachable so they may be replaced and/or modified to mount additional transducers and transmitters which may be required subsequent to the initial installation.

Plate 25 is mounted on permanent plate 12 and plate 26 is mounted on permanent plate 13. Of course, the number of pairs of permanent and impermanent plates mounted on the rack may vary in accordance with the mounting detail specified for the rack at any particular location.

Figure 2:
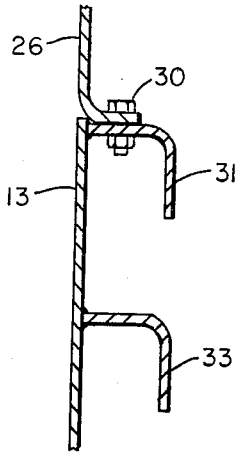
FIG. 2 is a side elevation of a portion of FIG. 1 showing details of the permanent and impermanent plate structures of the rack.

The side elevation of FIG. 2 is taken with the disclosure of FIG. 1 to give complete clarity to the unique juncture of the permanent and impermanent plate pairs which embody the present invention.

Assuming that FIG. 2 discloses permanent plate 13 and impermanent plate 26, it is disclosed that plate 13 is joined by welding to rib 31, which is joined by four fasteners 30, equally spaced along rib 31, to plate 26. Other forms of removable fasteners can be used, but FIG. 2 represents these fasteners as a simple bolt and nut combination.

Additionally, removable plate 26 is disclosed in FIG. 1 as extending across the front faces of vertical members 1 and 2 in order for additional fasteners 32 to join the removable plate to the vertical members 1 and 2. This joining of the impermanent plates to both their permanent plates and members 1 and 2 meets all specifications for strength and stability demanded of their union.

On a minor note, FIG. 2 discloses an additional angle member 33 welded to the rear surface of permanent plate 13. This additional angle structure extending horizontally along the rear surface of permanent plate 13 provides additional resistance to flexure of that plate.

Figure 3:
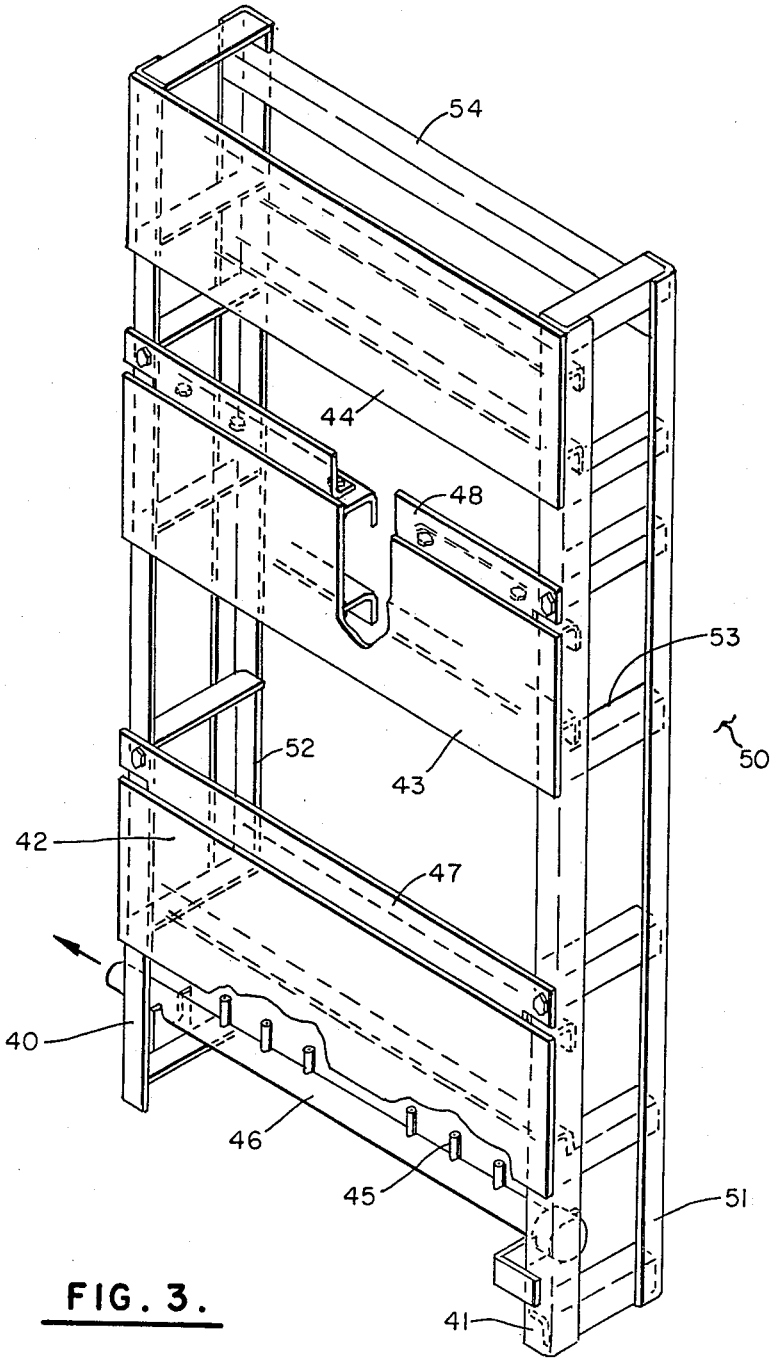
FIG. 3 is an isometric elevation of a wall-mounted rack embodying the invention.

FIG. 3 discloses the invention embodied in a rack adapted to be mounted on a vertical wall. This arrangement is in contrast with the floor mounting of the similar rack embodiment of FIG. 1 which is adapted for floor mounting.

In FIG. 3 the rack embodying the invention is organized around vertical members 40 and 41. Permanent plates 42, 43 and 44 are extended horizontally and welded to each of the members 40 and 41 to provide a basically rectangular configuration to the rack. Permanent plates 42 and 43 provide a mounting for various fluid components 45 which extend up from manifold 46 near the bottom of the rack. Impermanent, or removable, plates 47 and 48 are attached to the permanent plates under the concepts of the invention as disclosed in FIG. 1. The difference between the embodiments of FIG. 1 and FIG. 3 is in the overall mounting of the rack.

The embodiment of FIG. 1 is mounted on the surface of the horizontal floor. The embodiment of FIG. 3 is mounted on the vertical surface of wall 50.

To remove plates 47 and 48, the rack must be mounted on wall 50 to provide access to the rear of these plates. Therefore, the rack must be mounted a convenient distance from wall 50, but parallel to the wall. The distance between the wall and rack may vary, of course, but the mounting must be secure against unexpected forces which might threaten dislodgement of the rack and the transducers and transmitters mounted on the rack.

The present invention provides a frame basically organized around vertical members 51 and 52. These vertical members are mounted on wall 50, are secured to wall 50 in any way which will provide the required stability, and are oriented to parallel vertical rack members 40 and 41.

Vertical frame members 51 and 52 are disclosed in the simple form of angles with similar angles extended between elongated members of the frame and the elongated members 40 and 41 of the rack.

Of course, the short extension members 53 can be duplicated along the vertical lengths of the vertical members that connect the number of times required to give the required union strength between the frame and rack. In FIG. 3, an extension member 53 is joined on one end to the vertical frame member and the other end to the vertical rack member at the elevation of a permanent plate. A top extension member 53 at each side of the rack is provided an additional elongated right angle member 54 for additional stability.

As in the embodiment of FIG. 1, all of the frame and rack members are formed of stainless steel. With the exception of the impermanent, or removable, plates 47 and 48, the stainless steel members are permanently welded to each other with unions which are sized to successfully resist contemplated forces to which the frame and rack will be subjected as they are mounted on wall 50.

Figure 4:
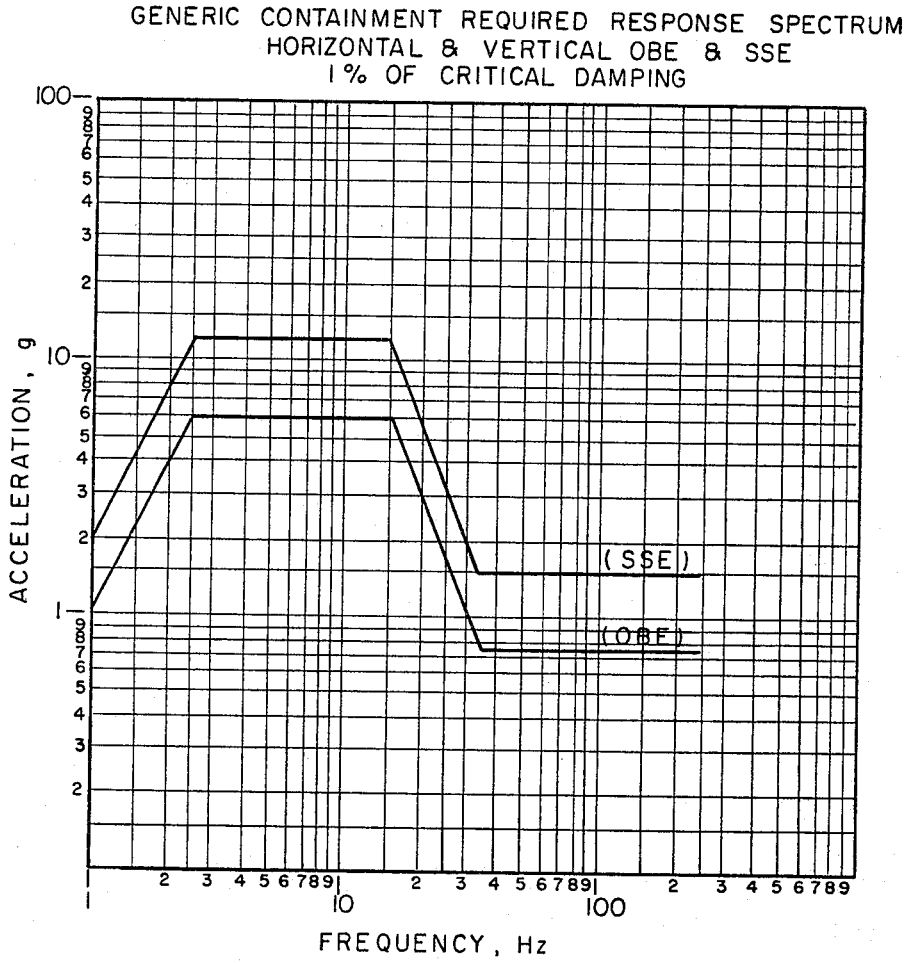
FIG. 4 is a prediction curve related to expected seismic shocks.
Figure 5:
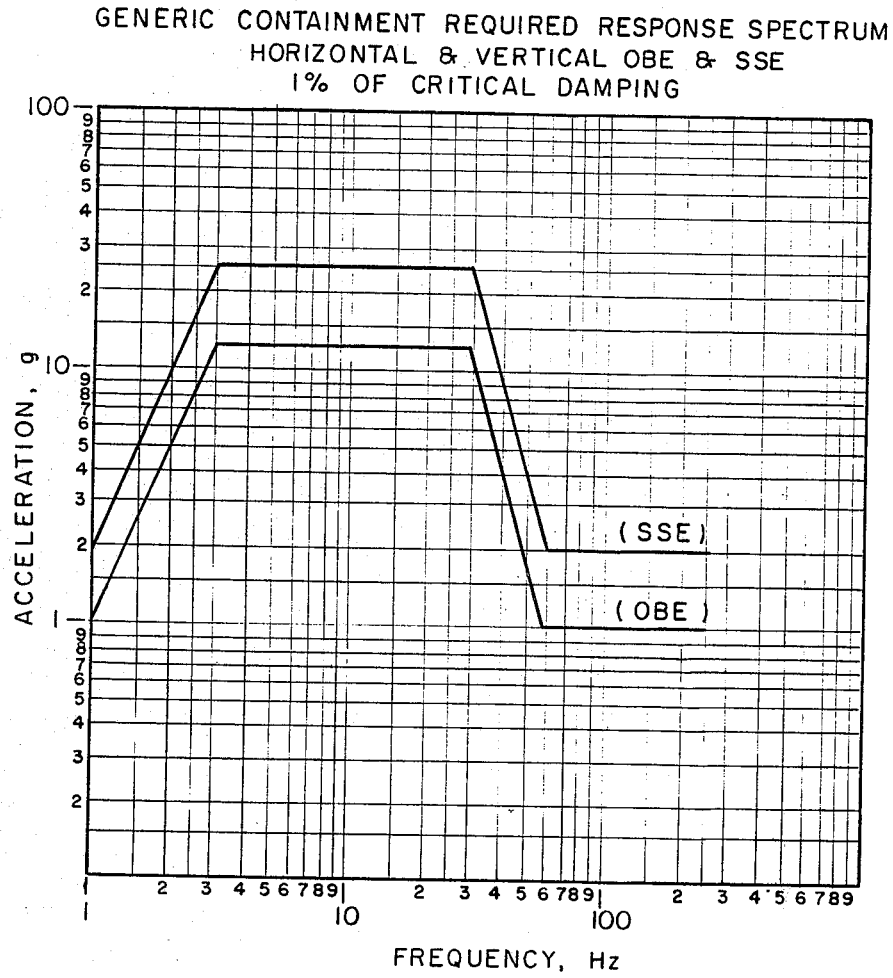
FIG. 5 is a curve depicting acceptable limits to anticipated shocks to the structure.

The function of the present invention in its embodiment may be found in the dynamic response to earthquake shocks required by regulatory agencies and various codes and standards, as illustrated by the dynamic response spectrum curves of FIGS. 4 and 5. FIG. 4, titled "Generic Containment Required Response Spectrum", describes predicted levels and frequencies of earthquake shocks at the rack supports. FIG. 5, titled "Generic Module Required Response Spectrum", specifies acceptable limits in levels and frequencies of anticipated shocks imparted to the rack. Computer software models of the rack embodying the invention were made using finite element computer code. Results of the computer runs included loads, moments and stresses in the structural members of the rack, and dynamic response characteristics including natural frequencies. The final design for the inventive rack has been verified to have no natural frequencies that can respond adversely to harmful shocks. This design has also been verified for the impermanent structural members that provide flexibility in mounting arrangements of the instruments. Essentially, the rack is a carefully tuned structure.

This invention meets the necessity for the above-described shock specifications. It is unique in that it has universal application for process instrumentation in a hostile environment with features giving mounting flexibility.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A mechanical framework for the support of instrumentalities at selected locations in a nuclear power installation, the framework having a successful resistance to seismic forces and environmental conditions resulting from coolant escape, including, a first pair of parallel stainless steel structural members, a plurality of stainless steel plates permanently welded between the first pair of structural members to form a rectangular rack, means for mounting the first pair of parallel structural members in a substantially vertical position, a stainless steel plate adapted to be mounted on each of a selected one of the plurality of stainless steel plates which are permanently welded to the first pair of structural members, means for detachably mounting the detachable stainless steel plate to its permanent stainless steel plate, conduits and auxiliary instrumentalities ranged and attached to the permanent plates for extension to connection with instrumentalities mounted on the detachable plates, and instrumentalities mounted on the detachable plates and adapted to be connected to the conduits mounted on the permanent plates.

2. The framework of claim 1 in which the means for mounting the detachable stainless steel plate to its permanent stainless steel plate includes, a flange on the upper edge of the permanent plate and a flange on the lower edge of the detachable plate joined by a plurality of fasteners.

3. The framework of claim 1, wherein, the permanent plate is reinforced against environmental forces by a rib member permanently welded along its horizontal length.

4. The framework of claim 1, wherein, each of a second pair of stainless steel structural members is permanently welded by a first of its ends to the lower end of the one of the first pair of parallel structural members, and each of a third pair of elongated stainless steel structural members is permanently welded between the second end of each of the second pair and the upper end of the one of the first parallel pair of members, to form a floor-mounted stand for the framework.

5. The framework of claim 4 including, a stainless steel plate permanently welded between each of the first, second and third structural members to reinforce the floor-mounted stand against environmental forces.

* * * * *